US009038336B2

(12) United States Patent
Albanese

(10) Patent No.: US 9,038,336 B2
(45) Date of Patent: May 26, 2015

(54) PORTABLE BUILDING FACADE SYSTEMS

(71) Applicant: Lourie Albanese, Delray Beach, FL (US)

(72) Inventor: Lourie Albanese, Delray Beach, FL (US)

( * ) Notice: Subject to any disclaimer, the term of this patent is extended or adjusted under 35 U.S.C. 154(b) by 0 days.

(21) Appl. No.: 13/736,876

(22) Filed: Jan. 8, 2013

(65) Prior Publication Data

US 2013/0174504 A1 Jul. 11, 2013

Related U.S. Application Data

(60) Provisional application No. 61/569,651, filed on Jan. 8, 2012.

(51) Int. Cl.
*E04B 1/344* (2006.01)
*E04F 13/08* (2006.01)
*E04H 1/12* (2006.01)

(52) U.S. Cl.
CPC ..... *E04F 13/0871* (2013.01); *E04H 1/1216* (2013.01)

(58) Field of Classification Search
USPC ..... 4/476–478; 52/32, 71, 235; 40/605, 40/606.7, 606.15, 606.16, 611.02, 611.03; 160/135; 256/26
See application file for complete search history.

(56) References Cited

U.S. PATENT DOCUMENTS

| | | | | |
|---|---|---|---|---|
| 3,842,557 | A | 10/1974 | Brown | |
| 4,851,811 | A | 7/1989 | Vallat et al. | |
| 5,014,477 | A | 5/1991 | MacDonald | |
| 5,579,616 | A | 12/1996 | Farag | |
| 5,941,002 | A * | 8/1999 | Rusin | 40/611.06 |
| 6,095,226 | A * | 8/2000 | Chen et al. | 160/135 |
| 6,418,672 | B1 | 7/2002 | Hampel | |
| 6,427,256 | B1 | 8/2002 | Mullett et al. | |
| 7,877,823 | B2 | 2/2011 | Hentschel | |
| 2002/0043349 | A1 * | 4/2002 | Rigby et al. | 160/135 |
| 2005/0045285 | A1 | 3/2005 | Katz | |
| 2010/0000136 | A1 * | 1/2010 | Allen et al. | 40/533 |
| 2010/0263309 | A1 | 10/2010 | Overgaard | |
| 2011/0146738 | A1 | 6/2011 | Hentschel | |
| 2012/0227174 | A1 | 9/2012 | Hentschel | |

* cited by examiner

*Primary Examiner* — William Gilbert
(74) *Attorney, Agent, or Firm* — Bennett Intellectual Property; Allen F. Bennett

(57) ABSTRACT

A system and method providing a facade for portable toilets and other structures includes a plurality of panels that mimic or emulate a more aesthetically pleasings structure. The facade may provide the appearance of a house or other structure to disguise the less appealing form of a portable toilet. One, two, three or more panels connect about a portable toilet structure and may partially or completely connect to the portable toilet structure itself. The facade is optionally comprised of lightweight and easily transportable material.

15 Claims, 6 Drawing Sheets

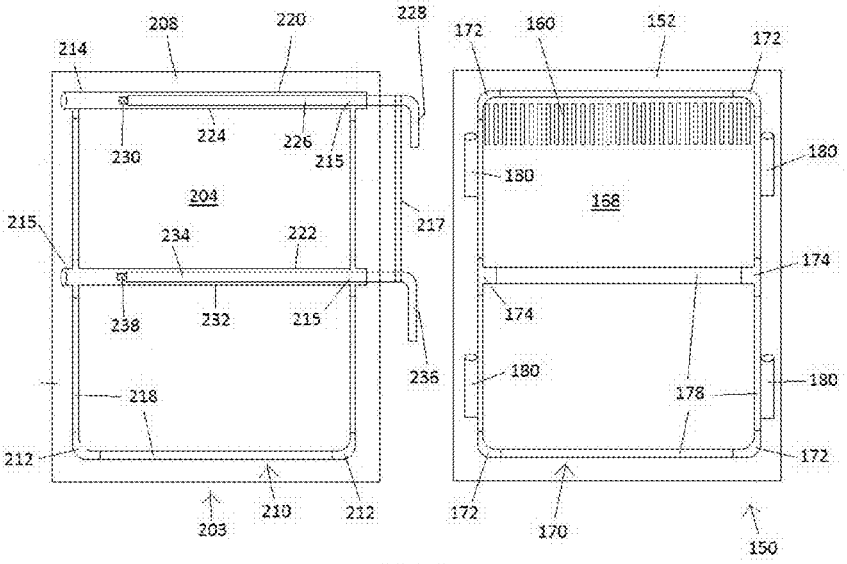
Fig. 5
Fig. 6
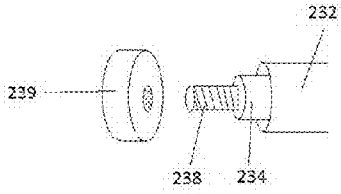
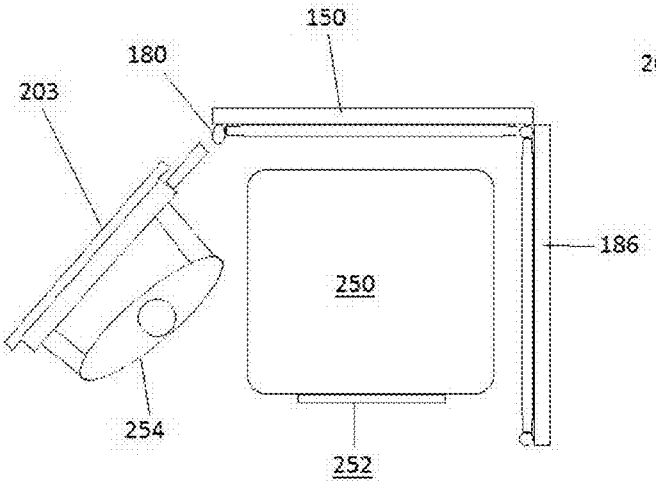
Fig. 7
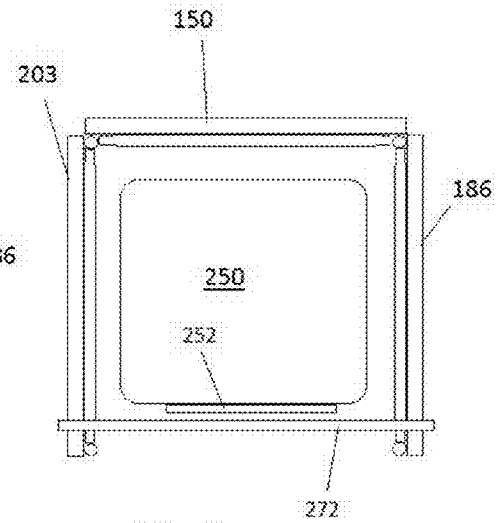
Fig. 8

PORTABLE BUILDING FACADE SYSTEMS

FIELD OF THE INVENTION

The present invention relates generally to systems and methods for a building facade, and more particularly to lightweight, portable building facades for use in improving the aesthetic qualities of portable building structures such as portable toilets, outhouses, dumpsters, refuse collection receptacles and the like or any other portable building. The facade systems typically emulate an aesthetically pleasing building such as a small house and may be free standing about a portable building or attached to the exterior of a portable building or other structure.

BACKGROUND

Portable toilets, or outhouses, are commonly used in a variety of settings. Construction sites, music and other festivals, parades, weddings, sporting events and other locations that temporarily require toilet facilities commonly have a plurality of outhouses as a necessity. These outhouses are designed for portability, functionality and have a generic and often unsightly appearance. They generally do not enhance the surroundings to which they are applied. Similarly, other structures, often portable buildings, such as storage sheds, dumpsters, outhouses, waste collection structures and/or animal shelters also may appear in locations where another more appropriate or aesthetically pleasing structure may be preferred.

There are many different designs for portable toilets and most innovations to them have related to increased portability and/or structural stability. However, there has been little progress in improving the appearance of portable toilets.

Use of facades on structures has been known since the time of the Romans. They typically include the use of mullions or similar structural elements to attach attractive exterior walls. These methods are typically complex, time consuming and impractically costly for use with a temporary structure that may only be used for a few days. In the case of permanent or semi-permanent structures, it may still be desirable to provide an inexpensive and simple facade that may be removed or replaced without substantial cost or effort. It is well known to use aluminum or other construction material extrusions in attaching a facade to a building, as exemplified by the disclosure and illustration thereof in U.S. Pat. No. 4,809,475 issued to Emmer on Mar. 7, 1989, but this and all other known facade extrusion mountings do not significantly diminish the difficulties in the procedures and complexity in the support constructions required in placing the facade in its operative position in covering relation over a building.

Pertinent to a somewhat lesser extent is the facade mounting described and illustrated in U.S. Pat. No. 4,581,089 issued to MacMillan on Apr. 8, 1986 in which facade panels are attached to a forward extension of a mullion, which is also a mounting technique used in accordance with the present invention, but absent in MacMillan is the use of an extrusion as proposed herein, which greatly simplifies the off-site preparation of the facade panels preparatory to their transportation to the building site for installation.

No patents or disclosures describe an exterior facade suitable for inexpensive, replaceable, interchangeable, and/or temporary application to a structure, including for example a temporary building such as portable toilets. It is therefore broadly an object of the present invention to overcome the complexities and other shortcomings of the prior art of facades so that they are more easily applied to structures including temporary buildings such as portable toilets. More particularly, it is an object to provide a facade manufactured inexpensively.

It is also desirable to provide a facade for buildings such as portable toilets that is easily folded and transported in an uncumbersome manner.

It is also desirable to provide a facade for buildings such as portable toilets that is lightweight and does not apply undue stress to a portable toilet structure.

It is also desirable to provide a facade for buildings such as portable toilets having an aesthetically pleasing appearance.

It is also desirable to provide a facade for buildings such as portable toilets that are replaceable and/or removable and may include advertising display materials.

The description of the invention which follows, together with the accompanying drawings should not be construed as limiting the invention to the example(s) shown and described, because those skilled in the art to which this invention appertains will be able to devise other forms thereof within the ambit of the appended claims.

SUMMARY

The present invention provides a system for a facade or exterior of a portable building, such as for example a portable toilet, comprising a plurality of panels which may include a front panel, a back panel, and two side panels and may optionally include one or more roof panels. Each of the panels may be comprised of more than one panel that connect to form a side of a building. Each of the panels may attach to adjacent panels by any of a variety of connection means, including for example tongue and groove, hinges, snaps, dowel rods, adhesives, nut and bolt or other methods known in the art.

Optionally the portable building facade has an aesthetically pleasing appearance which may emulate, for example, a residential building such as a house, a barn, a shed or other structure.

Optionally, the portable building facade may attach to the portable building by one or a plurality of means. Such attachment may be to the sides and/or the roof of the portable building and may provide stability and/or secure placement of the facade.

Accordingly, the primary object of the present invention is to provide a facade structure for use about a structure such as a portable toilet to give an aesthetically pleasing appearance while being lightweight and inexpensively manufactured.

These and other objects and advantages of the present invention will become apparent from a reading of the attached specification and appended claims. There has thus been outlined, rather broadly, the more important features of the invention in order that the detailed description thereof that follows may be better understood, and in order that the present contribution to the art may be better appreciated. There are features of the invention that will be described hereinafter and which will form the subject matter of the claims appended hereto.

BRIEF DESCRIPTION OF THE DRAWINGS

FIG. 5 shows a rear view of an alternative embodiment of two subpanels in accordance with the principles of the invention;

FIG. 6 shows an enlarged view of an extension arm and in the In accordance with the principles of the invention;

FIG. 7 shows a top view of a façade system with an outhouse in accordance with the principles of the invention;

FIG. 8 shows a top view of a façade system with an outhouse in accordance with the principles of the invention;

DETAILED DESCRIPTION

Figure 1:
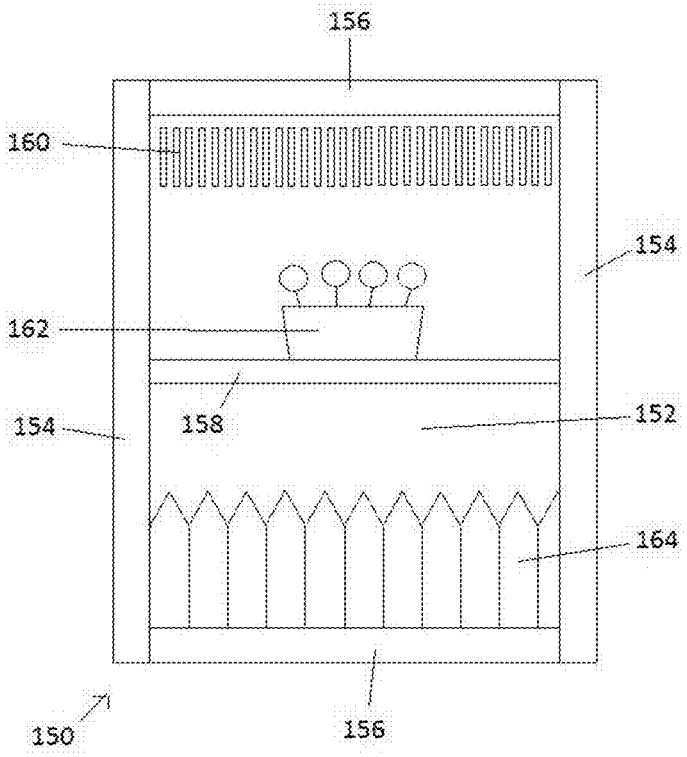
FIG. 1 shows a front view of a panel in accordance with the principles of the invention.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Figure 2:
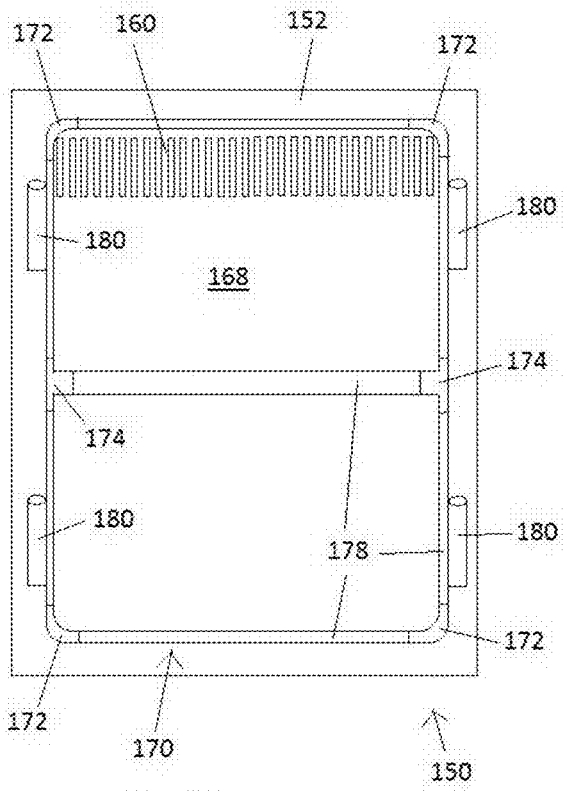
FIG. 2 shows a rear view of a panel accordance with principles of the invention.
Figure 3:
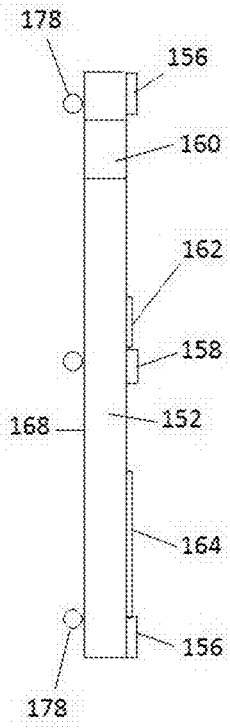
FIG. 3 shows a cross-sectional view of a panel in accordance with the principles of the invention.

FIGS. 1-3 show an alternative embodiment of a facade system in accordance with the principles of the present invention. FIG. 1 shows a front view of a panel 150. Panel 150 may have a backboard 152 with two horizontal beams 156 and two vertical beams 154 attached along the periphery of backboard 152. Backboard 152 may be comprised of a relatively lightweight material such as architectural foam, Styrofoam, and expanded polyolefin or other lightweight material. Backboard 152 may optionally be strengthened by applying a coating of rubber or other material. Such a coating may also enhance the aesthetic qualities of backboard 152, may protect the panel from deterioration and may improve the overall appearance of the façade. Horizontal beams 156 and vertical beams 154 may improve the appearance of and add strength to the panel 150. Horizontal beam 158 may optionally be included. Panel 150 may also optionally include one or more slits 160 that may allow airflow through the facade. Slits 160 may be located at the top of the panel 150 as shown in FIG. 7, or may be located elsewhere. Slits 160 may be incorporated into or hidden by the ornamental features of the panel 150. The panel 150 may also include a variety of ornamentation. In this embodiment an artificial flower pot 162 and artificial fence 164 may give the panel 150 and appearance of a wall of a home.

FIG. 2 shows a rear view of the panel 150. The rear side 168 of panel 150 includes a frame 170 that may provide support, strength and rigidity to panel 150. In this embodiment, frame 170 may be comprised of PVC. Elbows 172 and T joints 174 are connected by pipes 178. Frame 170 may be lightweight and sturdy. In this embodiment, the frame 170 may be substantially rectangular and substantially outlines the panel 150 and may include an optional horizontal support 158. The frame 170 may be of different shapes and may optionally include diagonal or other supports. Because both the backboard 152 and frame 170 are relatively lightweight, the panel 150 may be easier to transport and carry. Frame 170 also includes sleeves 180. As will be described in more detail below, sleeves 180 may be used to form a joint with and removably affix panel 150 to other panels.

FIG. 3 shows a cross-sectional side view of panel 150. The pipes 178 and other components of frame 170 may be affixed to the rear 168 of panel 150 by any suitable means, including, but not limited to, glue, adhesives, nails, bolts, twine, plastic ties, slots and tabs and the like. Backboard 152 day preferably be relatively thin. Similarly, beams 154, 156 and 158 may be attached to the backboard 152 and each other by any suitable means, including nails, screws, bolts, adhesives, dowels and the like. For example, 6 to 8 bolts may be placed through the panel 150 and the frame 170 and secured with washers and nuts.

Figure 4:
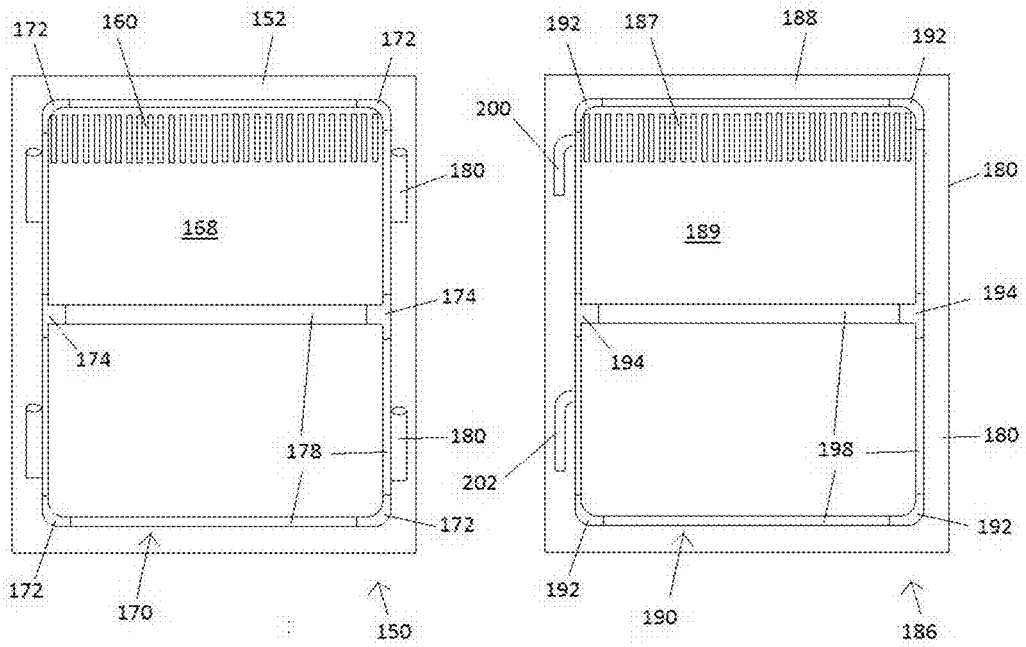
FIG. 4 shows a rear view of two panels in accordance with the principles of the invention.

FIG. 4 shows panel 150 in conjunction with panel 186. Panel 186 may include backboard 188 having a frame 190 attached to its rear side 189. Similar to frame 170, frame 190 may be comprised of PVC, including elbows 192 and T joints 194 connected by pipes 198. Frame 190 may also include an upper hinge pin 200 and a lower hinge pin 202. Hinge pins 200 and 202 may be inserted into sleeves 180 in order to removably connect panels 150 and 186. Hinge pins 200 and 202 may have a diameter sufficiently smaller than the inside diameter of sleeves 180 to provide "wiggle room" in the connection between panels 150 and 186. The façade system of the invention may be utilized in places where the ground is uneven or may change. Allowing panels 150 and 186 to move relative to one another while maintaining their connection at joints may be desirable.

In this embodiment, hinge pin 200 may shorter than hinge pin 202. When attaching panel 186 to panel 150, hinge pin 202 may be aligned with and inserted into a sleeve 180 first. A person assembling the panels may then align hinge pin 200 with sleeve 180 and inserted. This design thus may allow the assembler to align one hinge pin at a time with its respective sleeve. This may simplify assembly. Optionally, upper hinge pin 200 may be longer and lower hinge pin 202 may be shorter. Optionally, hinge pins may be of equal length. It may also be desirable to provide tapered hinge pins or sleeves having annular flanges to facilitate ready assembly.

FIG. 5 shows panel 150 in conjunction with another panel 203 having a backboard 208. The rear side 204 of panel 203 includes a frame 210. Frame 210 may be similarly constructed of rigid and/or lightweight material like frames 170 and 190. Frame 210 may be comprised of PVC, including elbows 212, T joint 214, 4 way joints 215 and a plurality of pipes 218 connecting the elbows 212 and the joins 214. Frame 210 may also include extension arms 220 and 222. Extension arm 220 has a cylindrical housing 224 and a rod 226 that extends outwardly therefrom. At the distal end of rod 226 may include a hinge pin 228. The proximal end 230 of rod 226 may be threaded. Similarly, extension arm 222 may include a housing 232 and a rod 234 that extends outwardly therefrom. Rod 234 may have a hinge pin 236 on its distal end while its proximal end 238 may be threaded. Similar to hinge pins 200 and 202 of panel 186, hinge pins 228 and 236 of panel 203 may be of different lengths. Rods 226 and 234 may be telescopically extended to facilitate attachment of the panel 203 to the panel 150.

Panel 186 as shown in FIG. 5 must be aligned substantially perpendicular to panel 150 while hinge pins 200 and 202 are inserted into sleeves 180. Often, a façade system in accordance with the present invention may be constructed about an outhouse or other structure that is already in place. An assembler usually may stand facing the rear size of the panels during construction. If all three panels must be positioned at right angles during construction, and extant outhouse may get in the way and make assembly difficult, especially for a single person. The extension arms 220 and 222 shown in FIG. 11 allow the panel 203 to be attached to panel 150 while at an obtuse angle to, not perpendicular to, panel 150. Rods 226 and 234 may optionally be attached to stabilizer 217. Stabilizer 217 may facilitate rapid alignment of hinge pins 228 and 236.

Once panel 203 is attached to panel 150, rods 226 and 234 may be retracted into bodies 220 and 222 respectively. To secure rods 226 and 234 inside the bodies 224 and 232, an end cap may be attached to their distal ends. FIG. 6 shows this in more detail. Distal ends 238 of rod 234 protrudes from body 232 when the Rod 234 is fully retracted into the body 232. End cap 239 has a diameter greater than that of body 232. When end 239 is screwed on to distal end 238 of the Rod 234, the Rod is secured from sliding out of the body 232.

FIG. 7 illustrates how the panels may be attached to one another. Panels 150 and 186 are attached perpendicular to one another. They may be positioned about outhouse to 250 such that the door 252 is not obstructed. The rods 226 and 234 have been telescoped outward from their housings 224 and 232 respectively. This allows the assembler 254 to be positioned facing rear side 204 of panel 203. Once the assembler 254 has inserted the hinge pin 228 and 236 into the sleeves 180, he or she may move out from between panel 203 and outhouse 250, slide panel 203 toward panel 150 by retracting the rods 226 and 234. The assembler 254 may then swing of panel 203 such that it is perpendicular to panel 150.

FIG. 8 shows a fully assembled façade including panel 150, panel 186 and panel 203. Beam 272 attaches to panel 203 and panel 186 and may improve the stability of the façade 270.

Figure 9:
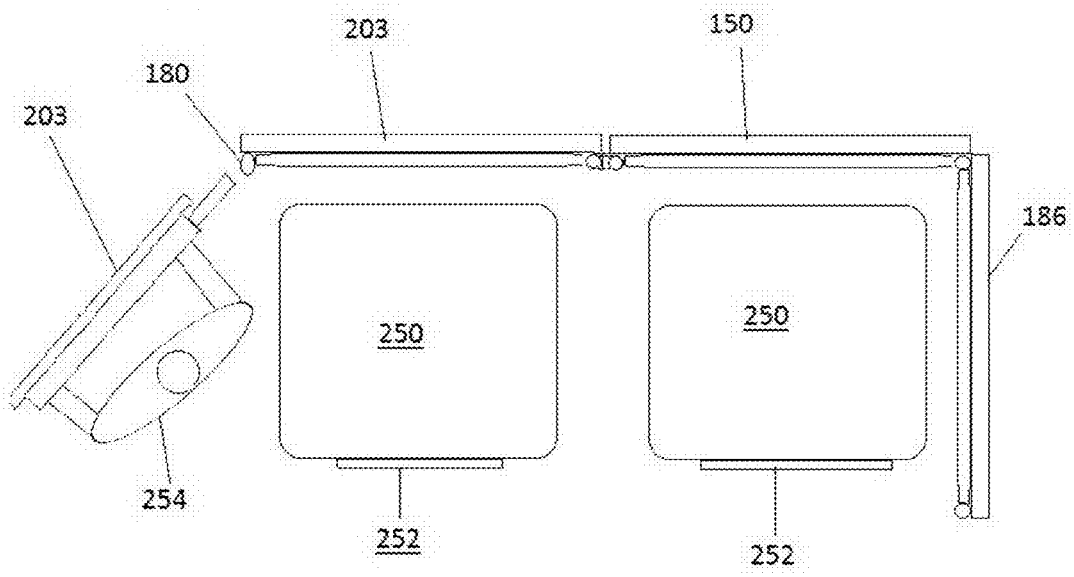
FIG. 9 shows a top view of a façade system with two out houses in accordance with the principles of the invention.

FIG. 9 shows panels in accordance with the principles of the invention used to form a façade system about to outhouse is 250. Panel 203 may be formed parallel to panel 152 extend the size of the façade system. A second panel 203 may then be attached and placed perpendicular to the first panel 203. Optionally, several panels 203 may be attached parallel to one another in order to accommodate as many outhouses as desired.

Figure 10:
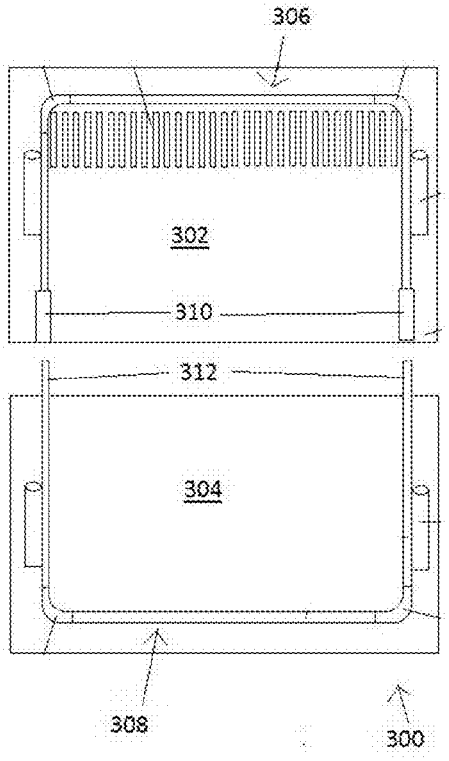
FIG. 10 shows a rear view of an alternative embodiment of a panel in accordance with the principles of the invention.

FIG. 10 shows an alternative embodiment of a panel 300 and accordance with the principles of the invention. Panel 300 is comprised of an upper backboard 302 and a lower backboard 304. upper backboard 302 has an upper frame 306 while lower backboard 304 has a lower frame 308. Upper frame 306 includes two sleeves 310. Attachment rods 312 may be aligned with and inserted into sleeves 310. Sleeves 310 may include linchpins or other devices for securing attachment rods 312 within the sleeves 310. It may be desirable to have the panels of the invention comprised of two or more smaller panels. FIG. 10 shows a panel divided into two subcomponents. However it may be desirable to divide panels into three or more subcomponents.

Figure 11:
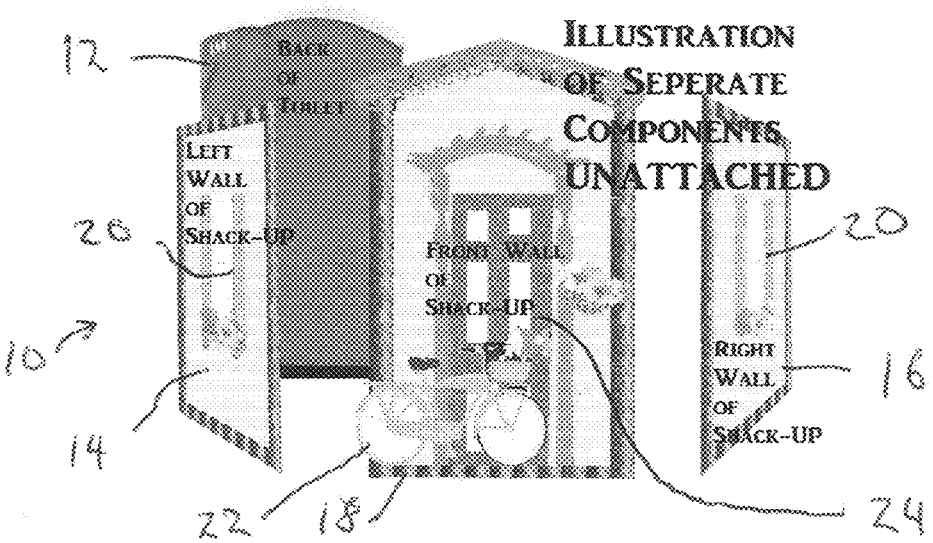
FIG. 11 is a front exploded view of a facade system for a portable toilet in accordance with the principles of the present invention.

FIG. 11 shows a facade system 10 for a portable toilet 12 designed to emulate a house. Other designs may be used to emulate other structures. Facade system 10 may include a left wall panel 14, a right wall panel 16 and a front wall panel 18. Left wall panel 14 and right wall panel 16 may each include an artificial window 20 to provide the appearance of the side of a house. Front wall panel 18 may include an artificial bicycle 22 to further create an aesthetically pleasing illusion. Front wall panel 18 may also include an artificial door 24 that may be inoperable. The facade system 10 may optionally include roof panel(s) (not shown) to further cover the portable toilet. Those skilled in the art will appreciate that a variety of other features may adorn the panels of a facade system to recreate the appearance of other structures, such as a barn, a shed, a castle, a tiki hut or other design of a person's choosing.

Figure 12:
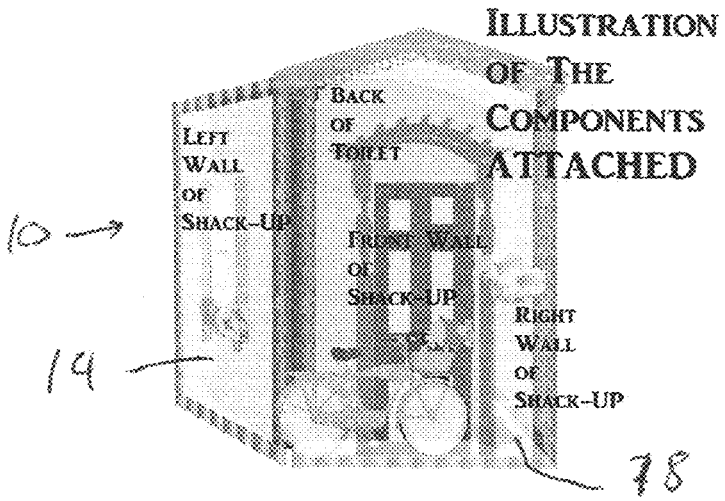
FIG. 12 is a front collapsed view of a facade system for a portable toilet in accordance with the principles of the present invention.

FIG. 12 shows the facade system 10 collapsed about a portable toilet. Left wall panel 14, right wall panel 16 and front wall panel 18 may all be connected about the outhouse to obscure it from view. Wall panels 14, 16 and 18 may be attached to one another by any of a variety of means. FIG. 3 shows the rear view of the facade system 10 which has no rear wall. The portable toilet 12 may be positioned within the facade system 10 and may be accessed through the rear. Optionally, the facade system 10 may include a fourth panel that has a door to allow access to the portable toilet.

As will be appreciated, the exemplary design of the facade system 10 is an improvement to the appearance of a portable toilet 12. The facade system may be comprised of any of a variety of designs, depending on the occasion. For example, at a sporting event, the facade may be adorned with images and colors of a sports team. At a wedding or anniversary celebration, the facade may include the colors and a design associated with the theme picked for the occasion. At a musical event, the facade system may include design elements associated with various music artists or genres. Event promoters may sell placement on the facade to advertisers.

Figure 13:
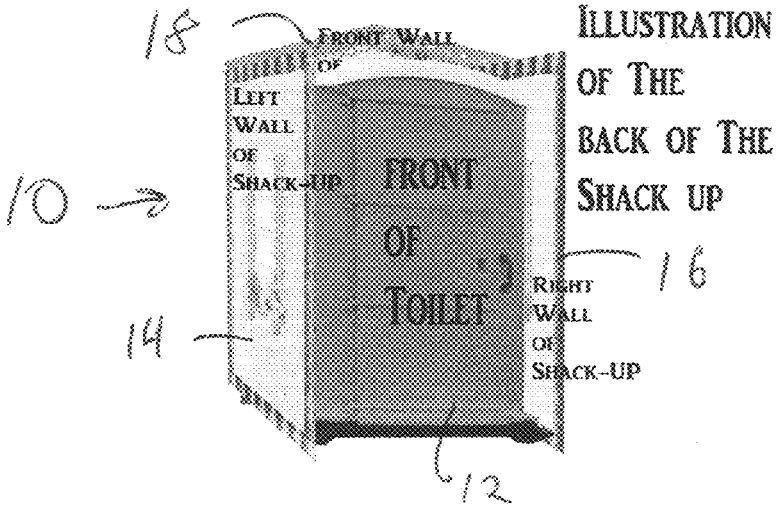
FIG. 13 is a rear view of a facade system for a portable toilet in accordance with the principles of the present invention.
Figure 14:
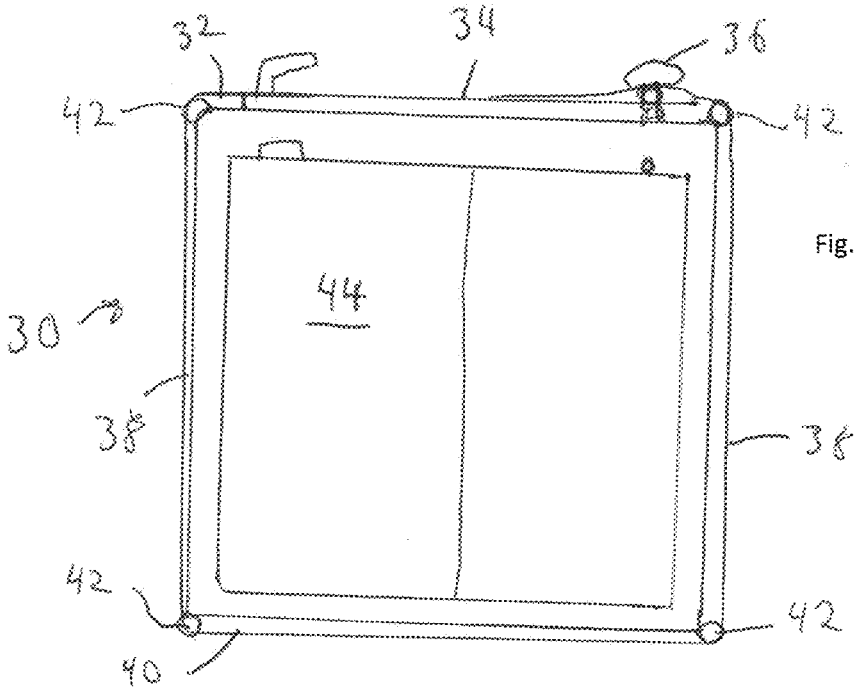
FIG. 14 is a top view of an alternative embodiment of a facade system for a portable toilet in accordance with the principles of the present invention.
Figure 15:
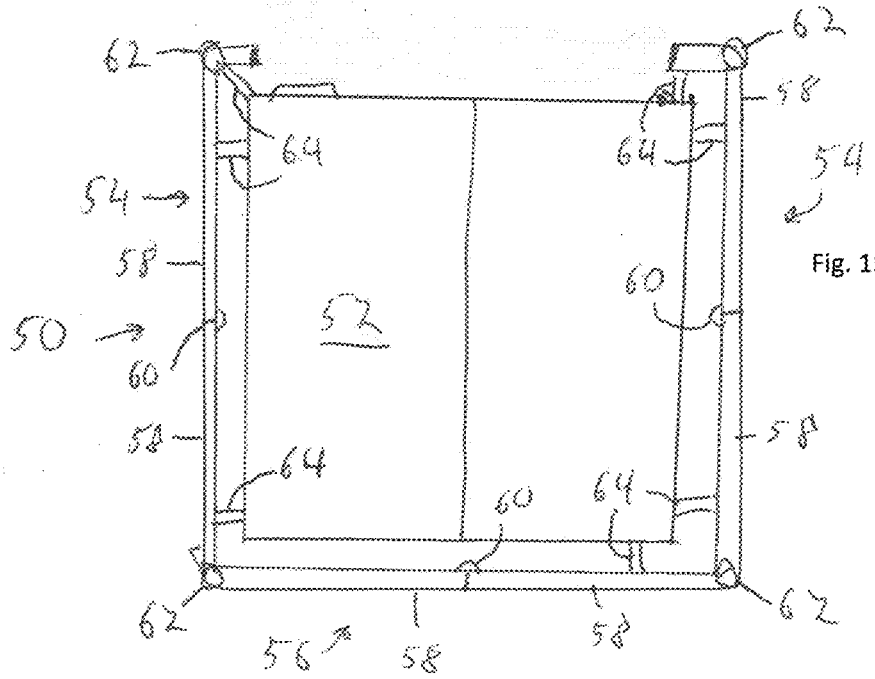
FIG. 15 is a top view of an alternative embodiment of a facade system for a portable toilet in accordance with the principles of the present invention including attachment means.

In another alternative, a series of multiple facade systems may align to form an aggregate image. The embodiment shown in FIGS. 13-15 provides the facade of a house. Optionally, the facade may form part of a picture and when aligned with associated facades may provide the complete image. If two portable toilets are used in tandem to provide male and female adjacent facilities, a facade may be used to create the illusion of a house having two front doors. It will be appreciated that various and sundry images may be used in conjunction with the present invention, which may not all be practically contemplated at this time.

Preferably, the facade system may be comprised of a lightweight material, such as for example foam plastic, architectural foam, plastics, vinyls, screens, fabrics (ie sunbrella), wood, metal alloys, polymers or any other material or the like. The facade system also may be quickly and easily assembled and/or disassembled to facilitate storage and transportation. The purpose of the facade system may be to create a pleasing appearance and does not include structural features. This may make the facade system less expensive to manufacture and use. However, those skilled in the art may appreciate that more permanent and/or more structurally enhanced facade systems may be desirable.

FIG. 14 shows an alternative embodiment of a facade system of the present invention having a front wall panel 32 that includes an operable door 34 that may allow ingress and egress to the interior of the facade system and the portable toilet 44 positioned therein. Door 34 may be attached to front wall panel 32 by pivotable hinge 36. Facade system 30 may include two side wall panels 38 and a rear wall panel 40. Front wall panel 32, side wall panels 38 and rear wall panel 40 may be attached to one another by a series of hinges 42. Hinges 42 may optionally be pivotable and allow for quick folding of the facade system to facilitate storage and portability. Optionally, hinges 42 may provide removable attachment between the panels of the facade system. The embodiment depicted in FIG. 4 shows that alternative designs, including four panels, an operable door and sundry hinges may be utilized in accordance with the principles of the invention. As with the first embodiment, this embodiment may optionally include one or more roof panels and may be designed to form a portion of a larger series of facade systems that create a larger design as described above.

FIG. 15 shows an alternative embodiment of a facade system 50 surrounding a portable toilet 52. Each of the side walls 54 and the front wall 56 may be comprised of two individual panels 58 that may interconnect at joints 60 to form a complete panel. The side and front panels may be joined at hinges 62. In this embodiment, a plurality of supports 64 may connect the panels of the facade system 50 to the portable toilet 52. Supports 64 may be attached to the panels of the facade system, to the hinges or to both, as may be seen in FIG. 5. The use of one or more supports 64 provides support and stability to both the facade structure 50 and the portable toilet 52. In another embodiment, it may be desirable for the panels of the facade to attach directly to the walls of a portable toilet or other structure.

Whereas, the present invention has been described in relation to the drawings attached hereto, it should be understood that other and further modifications, apart from those shown or suggested herein, may be made within the spirit and scope of this invention. Descriptions of the embodiments shown in the drawings should not be construed as limiting or defining the ordinary and plain meanings of the terms of the claims unless such is explicitly indicated.

As such, those skilled in the art will appreciate that the conception, upon which this disclosure is based, may readily be utilized as a basis four the designing of other structures, methods and systems for carrying out the several purposes of the present invention. It is important, therefore, that the claims be regarded as including such equivalent constructions insofar as they do not depart from the spirit and scope of the present invention.

The invention claimed is:

1. A facade for a portable building comprising two or more panels, each panel comprising a backboard and a frame, wherein each of the panels are removably attachable to one or more adjacent panels by a connection means;

wherein the connection means comprises one or more hinges formed by one or more sleeves on a first panel and one or more hinge pins on an adjacent panel, wherein the hinge pins are removably insertable into the sleeves;

wherein the one or more hinge pins are each located on one or more extension arms; and, wherein each of the one or more extension arms comprise a cylindrical housing, and a rod that extends outwardly from the cylindrical housing, each of the rods having a proximal end and a distal end;

wherein the one or more hinge pins are located at the proximal ends of the rods and the distal ends of the rods are threaded; and, wherein end caps may be attached to the threaded distal ends of the rods, thereby securing the rods from sliding out of the bodies of the extension arms.

2. The facade of claim 1 wherein the one or more hinge pins are tapered.

3. The facade of claim 2 wherein the one or more sleeves comprise two sleeves and the one or more hinge pins comprise two hinge pins.

4. The facade of claim 3 wherein the two hinge pins comprise a first hinge pin and a second hinge pin, wherein the length of the first hinge pin is greater than the length of the second hinge pin.

5. The facade of claim 4 wherein the one or more sleeves have a diameter that is greater than the diameter of the one or more hinge pins, thereby allowing the panels to move relative to one another while maintaining connection by the connection means.

6. The façade of claim 1 wherein the one or more sleeves comprise two sleeves and the one or more hinge pins comprise a first hinge pin and a second hinge pin, wherein the length of the first hinge pin is greater than the length of the second hinge pin.

7. The facade of claim 1 further comprising a stabilizer connecting a first one of the extension arms to a second one of the extension arms.

8. The facade of claim 1 wherein one or more of the panels include slits for airflow.

9. The facade of claim 1 wherein one or more of the backboards comprises an upper backboard and a lower backboard, having an upper frame and a lower frame, wherein the upper frame and the lower frame are removably attachable.

10. A facade for a portable building comprising two or more panels, each panel comprising a backboard and a frame, wherein each of the panels are removably attachable to one or more adjacent panels by a connection means;

wherein the connection means comprises one or more hinges formed by one or more sleeves on a first panel and one or more hinge pins on an adjacent panel, wherein the hinge pins are removably insertable into the sleeves; wherein the one or more hinge pins are located on one or more extension arms; and, wherein each of the one or more extension arms comprise a cylindrical housing and a rod that extends outwardly from the cylindrical housing.

11. The facade of claim 10 further comprising an end cap, wherein the hinge pin is located at a proximal end of the rod and a distal end of the rod is threaded; and, wherein the end cap may be attached to the threaded distal end of the rod, thereby securing the rod from sliding out of the body.

12. The facade of claim 11 wherein each of the backboards is strengthened by applying a coating.

13. A facade for a portable building comprising:

two or more panels, each panel comprising a backboard and a frame;

wherein each of the panels are removably attachable to adjacent panels by hinges formed by two sleeves, a first hinge pin and a second hinge pin;

wherein the length of the first hinge pin is greater than the length of the second hinge pin;

wherein the sleeves have diameters that are greater than diameters of the hinge pins, thereby allowing the panels to move relative to one another while maintaining connection at the connection means;

wherein the first hinge pin is located on a first extension arm and the second hinge pin is located on a second extension arm;

wherein the extension arms each comprise a cylindrical housing, and a rod that extends outwardly from the cylindrical housing, and wherein the hinge pins are located at proximal ends of the rods and distal ends of the rods are threaded, and wherein end caps may be attached to the threaded distal end of the rod, thereby securing the rod from sliding out of the body.

14. The facade of claim 13 further comprising a stabilizer connecting the first extension arm and the second extension arm.

15. The facade of claim 13 wherein one or more of the backboards comprises an upper backboard and a lower backboard, having an upper frame and a lower frame, wherein the upper frame and the lower frame are removably attachable.

* * * * *